US005857682A

United States Patent [19]

Hyman

[11] Patent Number: 5,857,682

[45] Date of Patent: Jan. 12, 1999

[54] SNOWBOARD STORAGE COMPARTMENT

[76] Inventor: Jeffrey N. Hyman, 1 Metacomet St., Medfield, Mass. 02052

[21] Appl. No.: 833,748

[22] Filed: Apr. 9, 1997

[51] Int. Cl.[6] ..... A63C 9/10

[52] U.S. Cl. ..... 280/14.2; 280/809; 220/334

[58] Field of Search ..... 280/14.2, 633, 280/636, 509, 814, 816, 87.042; 441/72, 74; 220/410, 334, 342; 206/503, 508, 372, 376; 70/57, 58, 63, 69

[56] References Cited

U.S. PATENT DOCUMENTS

| | | | |
|---|---|---|---|
| 242,863 | 11/1881 | Zurich | 280/816 |
| 4,474,116 | 10/1984 | Castenada, Jr. et al. | 70/63 |
| 4,685,697 | 8/1987 | Thorley . | |
| 4,955,835 | 9/1990 | Hollingsworth . | |
| 5,065,878 | 11/1991 | Altmann et al. | 220/334 |
| 5,096,103 | 3/1992 | Baugh . | |
| 5,473,917 | 12/1995 | Say . | |
| 5,511,662 | 4/1996 | Amoroso et al. | 206/376 |
| 5,558,355 | 9/1996 | Henry | 280/14.2 |
| 5,660,410 | 8/1997 | Alden | 280/14.2 |

FOREIGN PATENT DOCUMENTS

| | | | |
|---|---|---|---|
| 3325-819-A | 12/1984 | Germany | 441/74 |

*Primary Examiner*—D. Glenn Dayoan
*Assistant Examiner*—Clovia Hamilton
*Attorney, Agent, or Firm*—Leon R. Yankwich

[57] ABSTRACT

A storage compartment for mounting to a snowboard having a plurality of pre-existing threaded mounting holes includes a base member, a lid member hinged to the base member, and an insert fitted within the base member for receiving loose objects such as a wrench, wax, a locking cable and/or personal items. An anchoring post is secured to the base member. A closed loop end of a locking cable is passed around the anchoring post and the other end of the locking cable extends through an aperture formed in an end wall of the lid or base member where it is secured to a fixed object. A lock is provided to lock the lid member to the base member to prevent removal of the locking cable and theft of the snowboard when the snowboard is secured to the fixed object.

19 Claims, 4 Drawing Sheets

SNOWBOARD STORAGE COMPARTMENT

INTRODUCTION

The present invention relates to compartments for securely storing and locking objects. More specifically, the present invention relates to a multi-purpose, lockable storage compartment specifically adapted and proportionally sized to be securely mounted to a snowboard.

BACKGROUND

There are many accessories related to the sport of snowboarding such as small adjustment tools for rapidly making "on the spot" adjustments to the boot bindings. These adjustments are often made while the user is engaged in the sport and may depend on factors such as a change in terrain or the user's preference. It is therefore often desirable and at times essential to have certain tools for making such adjustments, as well as security locks, personal items and related accessories available while participating in the sport. Typically the user must carry any cable locks, tools and/or small personal items in a pocket of a coat, pant or backpack, etc. This makes it easy for items to be misplaced or stolen if left unattended and makes it possible for the user to injure themself while participating in the sport by falling on an object stored in a pocket or backpack. Further, when using conventional cable lock systems alone, the user is limited to placement of the cable through a part of a boot binding, thus making it easy for a would-be thief to simply unscrew the three or four anchoring screws of a boot binding, leave the binding, and take the board, the board being the item of greater value. Some previous attempts have been made at devising storage packs that are fastened to the equipment by means of hook-and-loop (Velcro) engagements strips and at a retractable ski leash devices which must be mounted by drilling directly into the surface of the equipment for proper installation.

U.S. Pat. No. 5,096,103 to Baugh discloses a hip or waist pack which can be worn around the waist for carrying personal items and which can be secured to a snowboard by hook-and-loop fasteners, whereby it can be transported on a snowboard and then removed for carrying the rider's personal items around his/her waist when not in use. Waist packs can easily be ripped or torn while being used and are not equipped to be locked to the equipment or to prevent the removal of the pack or of the articles stored therein. Hook-and-loop fasteners are not a secure means of mounting the waist pack to the surface of the equipment, which is a concern as snowboards and the like are subject to rigorous use which can bump and dislodge a waist pack from the surface while in use. Additionally, snow can pack into the hook side of the fastener, eliminating the ability to make a fastening engagement with the looped side of the fastener.

U.S. Pat. No. 4,685,697 to Thorley discloses a retractable leash or lanyard interconnecting a ski and ski boot for retrieving a loose ski and more particularly to such a ski-mounted device employing dual purpose locking means, the clasp of which is used for attaching one end of the leash to the user's boot and/or for locking the ski to a relatively stationary structure when the ski is not in use. This device does not provide a storage capability for items which are desirable to have while participating in the sport. Further, this device is disadvantageous because it must be mounted by a professional, if the integrity of the ski construction is to be maintained, which is time-consuming, expensive and inconvenient to the user. Additionally, the device must be mounted by drilling into the surface of the ski, which on a snowboard would adversely affect the integrity of the complex laminated material from which snowboards typically are made.

It is therefore an object of the present invention to provide a new and improved snowboard storage compartment which can be mounted easily on a snowboard and which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of certain preferred embodiments.

SUMMARY

The principles of the invention may be used to advantage to provide a storage compartment adapted to be mounted on a snowboard having a plurality of pre-existing mounting holes.

In accordance with a first aspect a storage compartment comprises a base member having a bottom, opposed side and end walls and a lid member hinged to the base member, which can be securely attached to a snowboard via arcuate slots formed in the bottom of the base member which are aligned with available pre-existing mounting holes on the snowboard.

In accordance with another aspect an insert is provided to fit within the base member and is adapted to receive any number of loose objects such as a wrench, wax, a locking cable, and other personal items. The insert has recesses formed to receive such loose objects thereby providing an integral, properly fitted storage compartment for tools and or other small accessories or personal items which are desirable and often essential to have while participating in the sport.

In accordance with another aspect an anchoring post is secured to or made part of the base member. A closed loop at a first end of a locking cable may be passed over the anchoring post, the locking cable passed through an aperture in a side wall of the base member, and a free second end of the locking cable may be secured to a fixed object such as a pole. The locking cable thus is safely secured to the storage compartment, and thus the snowboard to the fixed object, thereby reducing the likelihood of theft of the snowboard. The locking cable can additionally be placed around the user's leg while the snowboard is in use, thereby providing a safety strap or leash function.

In accordance with another aspect, a lock, such as a key or (preferably) a combination lock is provided to securely hold the lid member and the base member together in a closed position and to reduce the opportunity of removing the locking cable from the anchoring post and or objects stored within the compartment.

Preferred features of the present invention include a gripping or friction surface on a top surface of the lid member to be used as a foot rest or "stomp pad" when a user's foot is not secured within a binding. Placement of the user's foot in this position is often performed when, for example, the user briefly glides from a ski lift to a designated area to subsequently fasten a free boot into its binding.

From the foregoing disclosure, it will be readily apparent to those skilled in the art, that is, those who are knowledgeable or experienced in this area of technology, that the present invention provides a significant technological advance. Preferred embodiments of the snowboard storage compartment of the present invention provide a lightweight, compact, lockable, proportionally sized, multi-purpose, mountable and fully adjustable compartment which is easily attached to a snowboard or the like to provide easy access for storage and safe carrying of personal items, locks and tools as desired by the user, while further improving security by being securely fastened to a snowboard or the like by use of available pre-existing anchored binding mounting holes, by further providing an interior anchoring post for the attachment of the closed loop end of a cable lock for improved security, by further providing a safety strap means when mounted accordingly and a useful top surface which can serve as a foot rest ("stomp pad") if desired. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
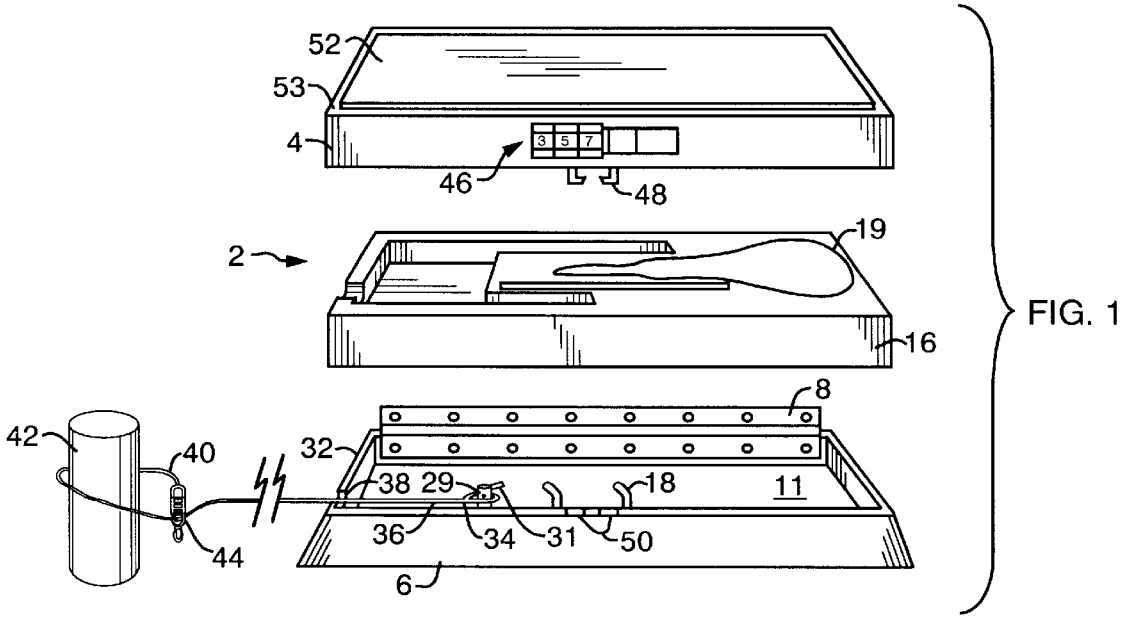
FIG. 1 is a schematic perspective exploded view of the storage compartment of the present invention.

The figures referred to above are not drawn to scale and should be understood to present a simplified representation of the invention, illustrative of the basic principles involved. Some features of the snowboard storage compartment depicted in the drawings have been enlarged or distorted relative to others to facilitate explanation and understanding. The same reference numbers are used in the drawings for the similar or identical components and features shown in various alternative embodiments. Snowboard storage compartments as disclosed above, will have configurations and components determined, in part, by the intended application and environment in which they are used.

DETAILED DESCRIPTION OF PREFERRED EMBODIMENTS

Referring to FIG. 1, a preferred embodiment of the storage compartment, designated generally by reference numeral 2, will be described in more detail. The storage compartment 2 comprises a lid 4 and a base member 6. The lid 4 and the base member 6 may be made of metal, plastic, or any other suitable material which will become readily apparent to those skilled in the art, given the benefit of this disclosure. Preferably, the lid 4 and the base member 6 are formed of multi-resin, injection molded, high-impact plastic, to provide a compartment that is durable and tamper-resistant while being also light in weight and inexpensively manufactured. The lid 4 and the base member 6 are preferably operably connected by hinge 8. Hinge 8 may be any type of hinge such as the piano type hinge shown in FIG. 1. It is to be appreciated that in an embodiment where the lid 4 and the base member 6 are formed of plastic, hinge 8 may be formed of two pieces, each integrally formed with one of lid 4 and base member 6, and which thereafter may be attached to operate as a hinge, thus reducing the complexity and costs associated with the manufacturing of the storage compartment 2.

An insert member 16 is shaped to fit within base member 6. The insert member 16 includes one or more proportional recesses 19 adapted to receive articles typically carried by an individual using a snowboard. Recesses 19 provide fitted storage for such articles and safely secure them while the user is participating in the sport. Recesses 19 may be shaped to receive a binding adjustment wrench which is commonly carried by an individual while snowboarding, a helically formed or other locking cable, wax, other personal items carried by the snowboarder, or any combination thereof. In a preferred embodiment, the insert member 16 is formed of a resilient material such as foam which provides a cushioning and molded bit for the items contained within storage compartment 2. Interchangeable inserts accommodating various combinations of tools and objects are contemplated.

Figure 2B:
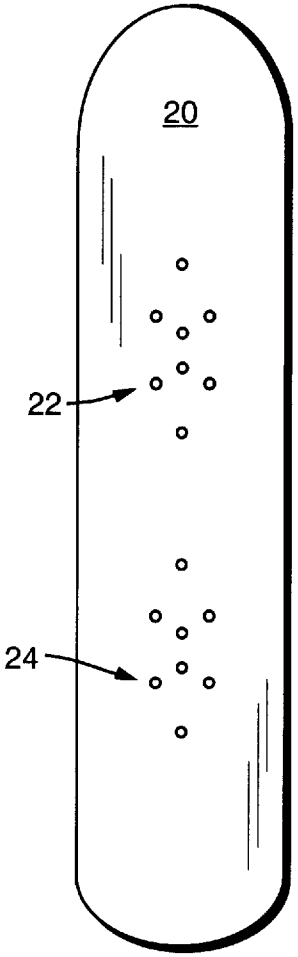
FIG. 2B is a schematic plan view of a second orientation of the threaded inserts of a snowboard used with the present invention.
Figure 2A:
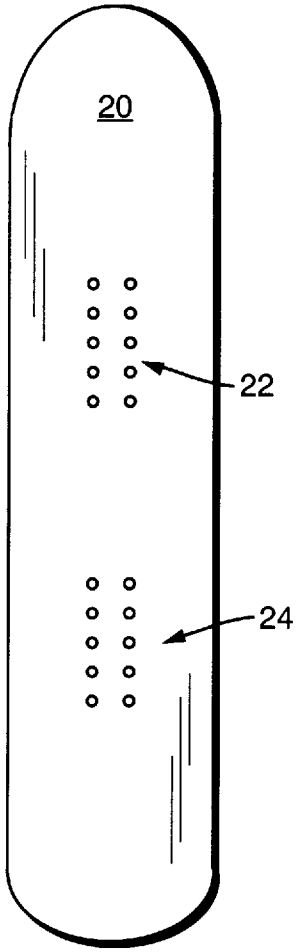
FIG. 2A is a schematic plan view of a first orientation of the threaded inserts of a snowboard used with the present invention.

As seen in FIG. 2A and FIG. 2B, a standard snowboard has front and rear arrays 22, 24, respectively, of mounting holes which are usually threaded inserts 26. Inserts 26 are usually formed of metal and are typically embedded within the snowboard 20 such that they are flush with the surface of the snowboard. Front and rear arrays 22, 24 are designed to receive threaded fasteners which secure a user's bindings to the snowboard 20 in a known manner. FIGS. 2A and 2B show forward 22 and rear 24 arrays of threaded inserts 26 retained in anchor binding mounting holes in the two arrangements that are becoming standard in this sport. Each array 22, 24 consists of eight to ten mounting holes arranged in two parallel rows, as seen in FIG. 2A, or in three rows to form a generally hexagon shaped pattern, as seen in FIG. 2B. Boot bindings (e.g., 27 in FIG. 4) are fastened to the snowboard 20 with screws (see, 28 in FIG. 3) using 2, 3 or 4 of the mounting holes with inserts 26 in each array. This leaves four or more mounting holes free for mounting the compartment 2 according to the present invention. The multiple inserts 26 provide flexibility for a user to mount their bindings in one of many possible configurations depending on snow conditions, binding placement, ability and other performance factors.

Figure 3:
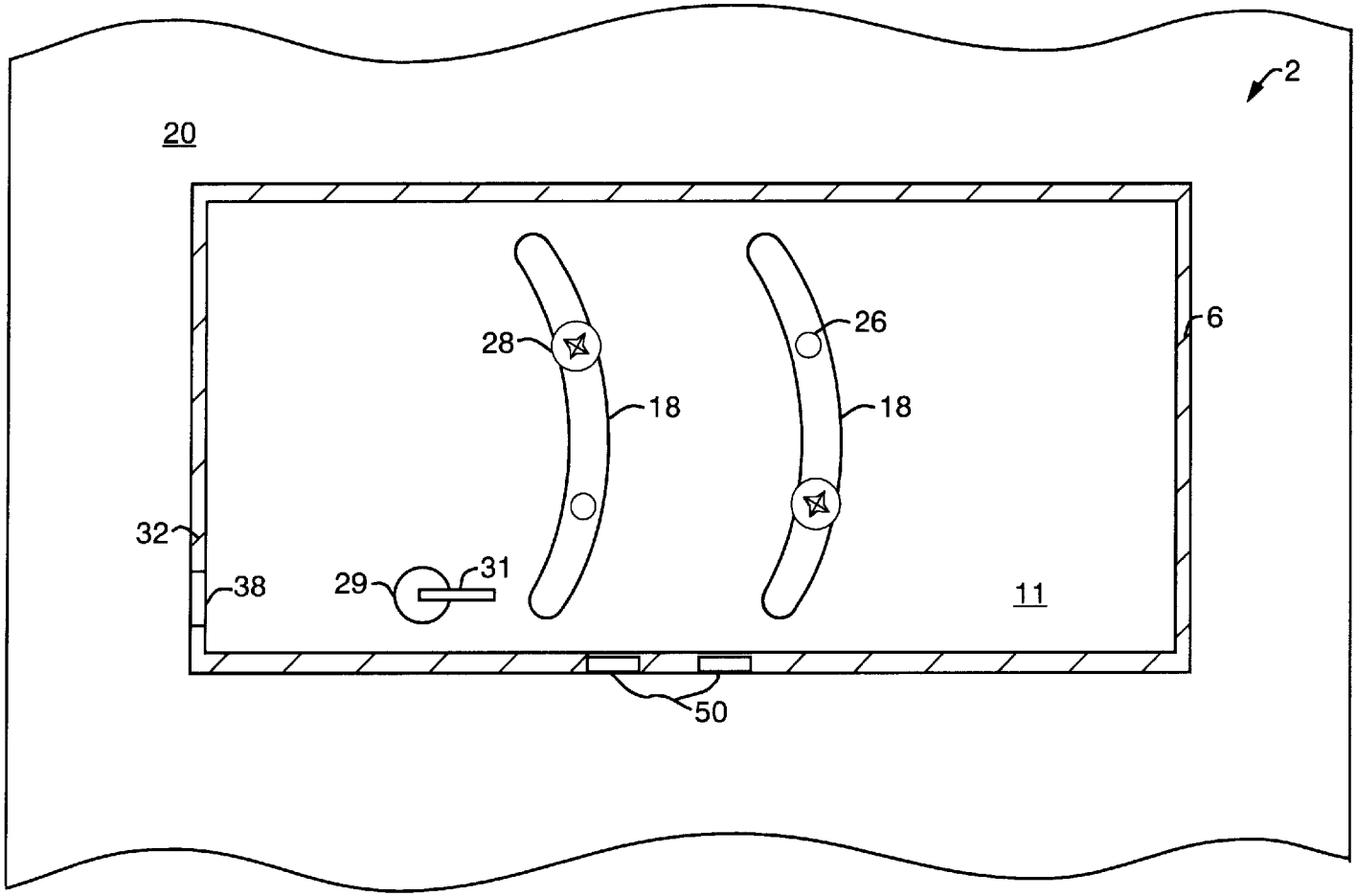
FIG. 3 is a schematic plan view of the base member of the storage compartment of the present invention.

Referring to FIG. 3, screw slots 18, preferably having a generally arcuate shape, are formed in the bottom surface 11 of the base member 6 to provide for mounting of the storage compartment 2 to snowboard 20, utilizing any free mounting holes and threaded inserts 26 not taken up or covered by the bindings. The storage compartment 2 is placed over snowboard 20 such that slots 18 are aligned with at least two available inserts 26. Screws 28 are then threadingly engaged (i.e., screwed into) the aligned inserts 26, thereby securely fastening the storage compartment 2 to the snowboard 20. In a preferred embodiment, screws 28 are Phillips head screws which become flush with bottom surface 11 when engaged with inserts 26. The slots 18 are properly sized, shaped, and spaced to allow a user to mount the storage compartment 2 in a variety of positions. In a preferred embodiment, the slots 18 are shaped to allow storage compartment 2 to pivot 140°, thereby allowing a wide variety of possible orientations for the storage compartment 2 with respect to the binding. This method of attachment advantageously allows a user to mount the storage compartment 2 to the snowboard 20 using pre-existing inserts 26 and reduces the need to drill into or otherwise compromise the integrity of the complex laminate structure of the snowboard 20.

Figure 4:
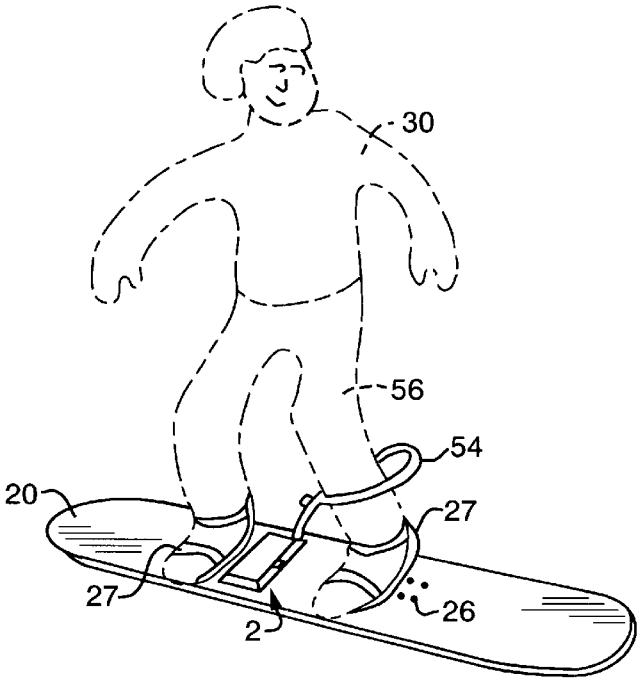
FIG. 4 is a schematic perspective view of the storage compartment of the present invention shown in use on a snowboard.

As seen in FIG. 4, when bindings 27 are mounted to the snowboard 20, a number of inserts 26 are not occupied by the bindings 27 and are therefore available for mounting the storage compartment 2. The storage compartment 2 can therefore easily be mounted to the snowboard 20 without interfering with the bindings 27 or the snowboarder 30. The snowboarder 30 therefore advantageously has a storage compartment 2 securely fastened to the snowboard 20, with any tools and personal belongings conveniently and safely stored inside.

In a preferred embodiment, an anchoring post 29 extends upwardly from the bottom surface 11 of the base member 6, as seen in FIGS. 1 and 3. In this preferred embodiment, the post 29 is integrally formed with the base member 6. A clip 31 is resiliently secured to the anchoring post 29 and extends outwardly and slightly upwardly from post 29 in a direction generally away from the end wall 32 of the base member 6. Referring to FIG. 1, the closed loop end 34 of a locking cable 36 is placed over the anchoring post 29, pushing clip 31 downward over post 29 until closed loop end 34 clears the clip 31, which then springs back to its original position. An aperture 38 is formed in the end wall 32 of the base member 6. The aperture 38 may, in another embodiment, be formed in an end wall of the lid 4, or in the end walls of both the lid 4 and the base member 6. Locking cable 36 extends through the aperture 38 and the free end 40 of the locking cable 36 is then looped around a stationary object such as a post or tree or any other accomodating stationary object (see, 42 in FIG. 1) and secured to the locking cable 36 with, e.g., a padlock or other preferred lock 44. It is to be appreciated that locking cable 36 may be of the type with a lock, for example a three digit combination lock, incorporated into free end 40 which can accordingly be locked to the locking cable 36 itself after the cable has been looped around an appropriate object. When the lid 4 is closed, the clip 31 is in resilient contact with the lid 4, thereby advantageously preventing the closed loop end 34 of the locking cable 36 from slipping off the post 29, for example, due to inadvertent jostling of the storage compartment 2 or purposeful attempts to free the locking cable 36. The clip 31 may be a coil spring wrapped around post 29 with a straight portion extending away from post 29, or any other suitable means which will serve to retain the closed loop end 34 on post 29.

In a preferred embodiment, a locking means 46 is provided to securely fasten the lid 4 to the base member 6 when the storage compartment 2 is in its closed position. The locking means 46 may be a three digit combination lock, as shown, with movable prongs 48 extending from the lid 4 and fitting into locking slots 50 formed in the base member 6. When the storage compartment 2 is locked in such a manner, the closed loop end 34 is securely fastened within the storage compartment 2, thereby providing secure attachment of the storage compartment 2 and, in turn, the snowboard to a non-movable object such as a pole (42). It is to be appreciated that locking means 46 may be a keyed lock, or any other suitable means for adequately securing the lid 4 and the base member 6 in a closed position.

In another preferred embodiment, a gripping surface in the form of a pad 52 is provided on a top surface 53 of lid 4. The pad 52 may be an adhesive backed pad secured to the lid 4 which provides enhanced gripping capabilities. Top surface 53 of the lid 4 may be recessed to receive the pad 52, or the pad 52 may simply be secured directly to the top surface 53 of the lid. When users descend from a ski lift, their rear foot is usually used to propel themselves forward by pushing off the ground and is therefore not fastened within the rear binding. The gripping of friction surface of the pad 52 provides the user with a foot rest, or "stomp pad" as it is commonly referred to by users of snowboards, when the compartment 2 is mounted in front of the user's rear binding position (24 in FIG. 2). In another preferred embodiment, the gripping surface may be provided by ridges formed in the upper surface of the lid 4 or any other suitable means of forming a non-skid surface where a user can rest their foot.

In another preferred embodiment, as seen in FIG. 4, one end of a tether 54 is looped around a leg 56 of the user 30 and the other end is secured within the storage compartment 2. The tether 54 may be a locking cable (36 in FIG. 1), a strap, or any other suitable means for providing the function of leashing the snowboard 20 to the leg 56 of the user 30.

Figure 5:
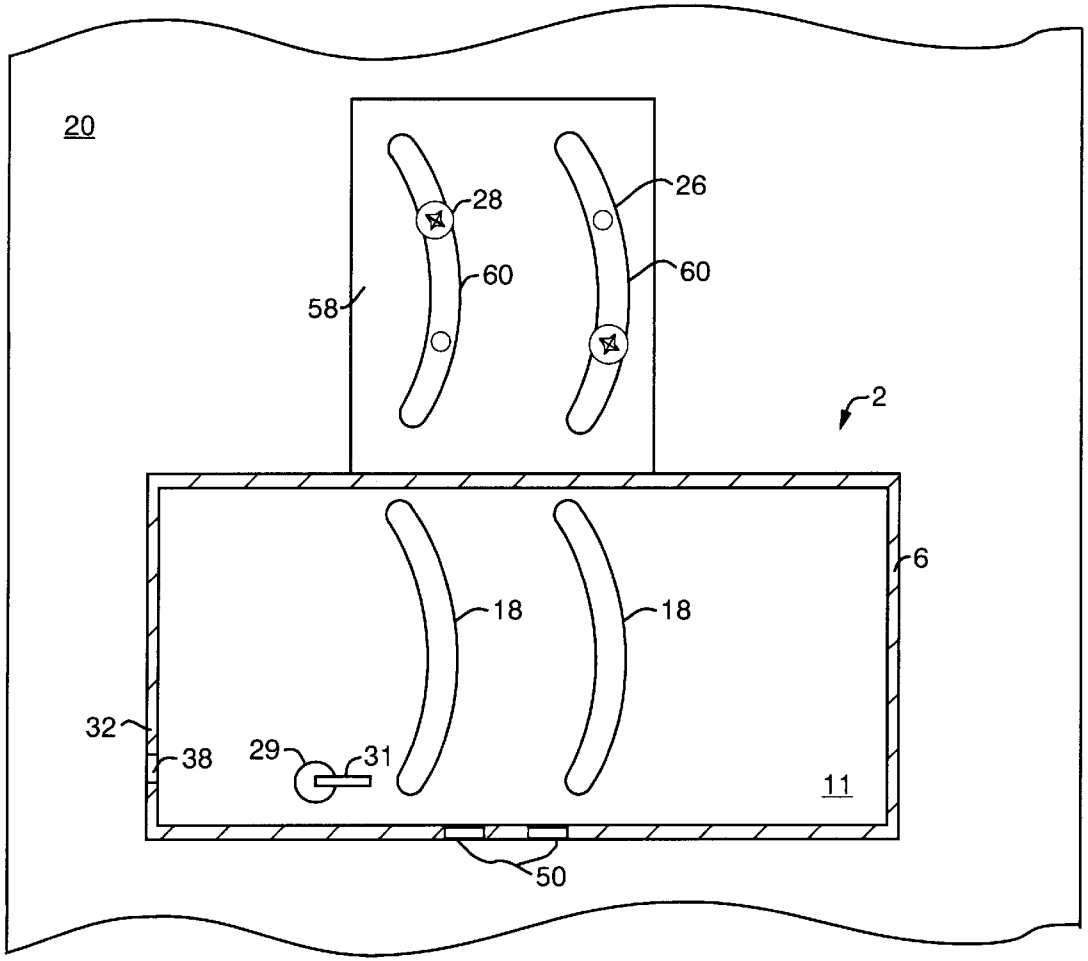
FIG. 5 is a schematic plan view of the base member of the storage compartment of the present invention shown with a flange attached thereto.

A user may choose, under certain circumstances, to mount their bindings on the snowboard such that no inserts are available for mounting the storage compartment. In another preferred embodiment, as seen in FIG. 5, flange 58 extends from base member 6. Screw slots 60, preferably having a generally arcuate shape, are formed in flange 58 to provide for mounting of the storage compartment 2 to snowboard 20. The storage compartment 2 is placed over snowboard 20 such that slots 60 are aligned with at least two inserts 26. Bindings 27 are then mounted over flange 58 to snowboard 20 in a standard manner. Screws 28 are then threadingly engaged with (i.e., screwed into) the aligned inserts 26, thereby securely fastening the bindings 27 and the storage compartment 2 to the snowboard 20.

In another embodiment, flange 58 may be provided as a separate member which is mounted both to snowboard 20 via inserts 26 and to base member 6. In a similar manner, bindings 27 are then mounted to snowboard 20 over flange 58.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

I claim:

1. A storage compartment adapted for mounting to a snowboard having a plurality of pre-existing binding mounting holes, comprising in combination:

a base member having a bottom, opposed end and side walls, and at least two arcuate slot openings in the bottom, positioned so that each slot will align with at least one pre-existing binding mounting hole not utilized to secure bindings to said snowboard;

a lid member hingedly attached to the base member, wherein said base member and said lid member fit cooperatively together in a closed position to form an enclosed space within the storage compartment; and locking means for securing said base member and said lid member in a closed position, wherein said base member further comprises an anchoring post adapted to receive one end of a locking cable, said anchoring post positioned so that when the base member and lid member are in a closed position, said one end of the locking cable is securely attached within said enclosed space, and wherein said base member and/or said lid member has an aperture sized to permit said locking cable to extend outside said enclosed space while the base member and lid member are in a closed position and said one end of the locking cable is secured within said enclosed space.

2. A storage compartment in accordance with claim 1 wherein said arcuate slots are positioned so as to align with pre-existing binding mounting holes oriented in a pattern as illustrated in FIG. 2A or FIG. 2B.

3. A storage compartment in accordance with claim 1 wherein said enclosed space is sufficient to accommodate and store an entire locking cable when not in use.

4. A storage compartment in accordance with claim 3 wherein the enclosed space is sufficient also to accommodate and store a wrench for adjusting a means for fastening the binding to said pre-existing binding mounting holes.

5. A storage compartment in accordance with claim 1 further comprising an insert fitted within the base member and adapted to receive loose objects for storage within the storage compartment.

6. A storage compartment in accordance with claim 5 wherein the insert is formed of a resilient material.

7. A storage compartment in accordance with claim 5 wherein the insert includes at least one recess shaped to receive at least one of the loose objects.

8. A storage compartment in accordance with claim 7 wherein the at least one recess is shaped to receive a wrench.

9. A storage compartment in accordance with claim 1 wherein the top surface of the lid member is provided with a gripping surface and in the closed position forms a stomp pad.

10. A storage compartment adapted for mounting to a snowboard having a plurality of threaded binding mounting holes in a patterned configuration, said storage compartment comprising:

a base member having a bottom, opposed end and side walls, and at least two arcuate slot openings in the bottom, positioned so that each slot will align with at least one pre-existing threaded binding mounting hole not utilized to secure bindings to said snowboard, the arcuate slot openings being sized to admit the shaft of a screw capable of threading engagement with the preexisting threaded binding mounting holes;

a lid member hingedly attached to the base member, wherein said base member and said lid member fit cooperatively together in a closed position to form an enclosed space within the storage compartment; and locking means for securing said base member and said lid member in a closed position, an insert of a flexible, resilient material sized to fit within said enclosed space and having recesses therein shaped to receive and securely hold one or more tools useful for adjusting bindings to the surface of a snowboard or for treating a surface of a snowboard, wherein said base member further comprises an anchoring post adapted to receive one end of a locking cable, said anchoring post positioned so that when the base member and lid member are in a closed position, said one end of the locking cable is securely attached within said enclosed space, wherein the top surface of the lid member is provided with a gripping surface and in the closed position forms a stomp pad, and wherein said base member and/or said lid member has an aperture sized to permit said locking cable to extend outside said enclosed space while the base member and lid member are in a closed position and said one end of the locking cable is secured within said enclosed space.

11. A storage compartment in accordance with claim 10 further comprising a tether having first and second ends, adapted to be secured at the first end to the anchoring post and at the second end to a leg of a user of the snowboard.

12. A snowboard having a plurality of binding mounting holes oriented in a patterned configuration and having a removable and adjustable storage compartment mounted thereon, said storage compartment comprising:

a base member having a bottom, opposed end and side walls, and at least two arcuate slot openings in the bottom, positioned so that each slot aligns with at least one of the plurality of binding mounting holes;

a lid member hingedly attached to the base member, wherein said base member and said lid member fit cooperatively together in a closed position to form an enclosed space within the storage compartment; and locking means for securing said base member and said lid member in a closed position, wherein said base member further comprises an anchoring post adapted to receive one end of a locking cable, said anchoring post positioned so that when the base member and lid member are in a closed position, said one end of the locking cable is securely attached within said enclosed space, wherein said base member and/or said lid member has an aperture sized to permit said locking cable to extend outside said enclosed space while the base member and lid member are in a closed position and said one end of the locking cable is secured within said enclosed space, wherein said base member is secured to said snowboard by at least one fastener extending through each of said arcuate openings to engage a binding mounting hole, such that securing said base member to the snowboard does not interfere with securing bindings to the snowboard using other binding mounting holes not used in securing the base member.

13. A snowboard in accordance with claim 12 wherein the top surface of the lid member is provided with a gripping surface and in the closed position forms a stomp pad.

14. A snowboard in accordance with claim 12 wherein said enclosed space is sufficient to accommodate and store an entire locking cable when not in use.

15. A snowboard in accordance with claim 14 wherein the enclosed space is sufficient also to accommodate and store a wrench for adjusting said fasteners.

16. A snowboard in accordance with claim 12 further comprising an insert fitted within the base member and adapted to receive loose objects for storage within the storage compartment.

17. A snowboard in accordance with claim 16 wherein the insert is formed of a resilient material.

18. A snowboard in accordance with claim 16 wherein the insert includes at least one recess shaped to receive at least one of the loose objects.

19. A snowboard in accordance with claim 18 wherein the at least one recess is shaped to receive a wrench.

* * * * *